United States Patent [19]

Maehara

[11] Patent Number: 4,637,841

[45] Date of Patent: Jan. 20, 1987

[54] SUPERPLASTIC DEFORMATION OF DUPLEX STAINLESS STEEL

[75] Inventor: Yasuhiro Maehara, Kobe, Japan

[73] Assignee: Sumitomo Metal Industries, Ltd., Osaka, Japan

[21] Appl. No.: 747,433

[22] Filed: Jun. 21, 1985

[30] Foreign Application Priority Data

Jun. 21, 1984 [JP] Japan ..... 59-128150
Jun. 21, 1984 [JP] Japan ..... 59-128151

[51] Int. Cl.[4] ..... C22C 8/00
[52] U.S. Cl. ..... 148/12 E; 148/12 EA
[58] Field of Search ..... 420/902; 148/12 E, 12 EA, 148/12 R, 37, 38

[56] References Cited

U.S. PATENT DOCUMENTS 3,951,697 4/1976 Sherby et al. ..... 148/12 R

FOREIGN PATENT DOCUMENTS 59-70719 4/1984 Japan ..... 148/12 EA

OTHER PUBLICATIONS

Metal Science, 5-76, pp. 182-188.

*Primary Examiner*—L. Dewayne Rutledge
*Assistant Examiner*—Deborah Yee
*Attorney, Agent, or Firm*—Burns, Doane, Swecker & Mathis

[57] ABSTRACT

A superplastic deforming process of a duplex stainless steel is disclosed. The process comprises the steps of:

heating a ferrite + austenite duplex stainless steel to a temperature between the alpha-temperature and a temperature 200° C. lower than the alpha-temperature, the heating temperature being 1000° C. or higher;

water quenching or force-cooling the duplex stainless steel to a temperature of 500° C. or lower, alternatively working the duplex stainless steel at a temperature of 700° C. or higher with a working ratio of 30% or more, or at a temperature lower than 700° C. with a working ratio of 20% or more;

reheating it to a temperature of between 700° C. and a temperature 200° C. lower than the alpha-temperature; and plastic deforming the thus-pretreated duplex stainless steel at a strain rate of $1\times10^{-4}-5\times10\ S^{-1}$.

12 Claims, No Drawings

SUPERPLASTIC DEFORMATION OF DUPLEX STAINLESS STEEL

BACKGROUND OF THE INVENTION

The present invention relates to a process for hot working a duplex ferrous alloy, e.g. duplex stainless steel. In particular, the present invention relates to a process for carrying out superplastic deformation of duplex stainless steel.

A duplex alloy which comprises a ferritic (alpha) phase and an austenitic (gamma) phase exhibits markedly improved properties such as strength, toughness, and weldability so that the industrial demand therefor has recently been increasing. However, a duplex alloy has also been known as a hard-deformable material, since it contains a duplex phase, i.e., a ferritic phase+austenitic phase.

In the prior art, in order to improve the hot workability of such a material, much effort has been made towards decreasing impurities such as sulfur, oxygen, etc. which are harmful to hot workability. Therefore, it has been possible to form products of a simple shape, such as plates, pipes, and simple forging products.

However, it is quite difficult to produce articles having a complicated shape, such as pipe joints, valves, etc. These products, therefore, have been produced by means of machining or casting, and such articles are accordingly expensive.

Superplastic deformation has recently been used to produce non-ferrous material products of a complicated shape. Regarding ferrous materials, especially duplex ferrous alloys, it has been reported that superplastic behavior can be observed in duplex ferrous alloys, such as duplex stainless steel containing large amounts of Cr, Mo, and Ni, which is well known as a hard-deformable material. For example, "Metal Science" May 1976, pp. 182–188, discloses a strain rate at which superplastic behavior is observed, although it is extremely low, e.g. for usual material $10^{-4}$–$10^{-5}$ $S^{-1}$ [1], and thus too low for economical industrial use. In addition, the presence of Ti(C,N) is essential to the superplastic deformation. Furthermore, this reference does not suggest anything about the presence of a finely dispersed ferrite+austenite duplex microstructure, which is effective to achieve superplastic deformation according to the present invention.

SUMMARY OF THE INVENTION

The object of the present invention is to provide a practical process for superplastic deformation of a duplex stainless steel which is less expensive but exhibits improved mechanical and chemical properties.

The present inventor performed intensive studies for the purpose of improving the hot workability, i.e. the superplastic characteristics of a duplex stainless steel which is relatively inexpensive and at the same time has satisfactory properties, e.g., good corrosion resistance as well as weldability.

The inventor of the present invention found that a duplex stainless steel could exhibit superplastic behavior if deformation were applied to a duplex stainless steel the microstructure of which had been precisely and carefully controlled. However, the strain rate to achieve superplastic deformation was generally low, and it takes a relatively long time to finish superplastic deformation, while maintaining a high temperature.

The inventor continued studying the superplastic behavior of the duplex stainless steel and discovered that there exists an optimal pretreatment for superplastic deformation of duplex stainless steel. When such a pretreatment is performed prior to deformation, a duplex stainless steel can exhibit superplastic behavior even at a strain rate which is close to that of usual rolling.

According to the findings of the present inventor, a duplex stainless steel exhibits superplastic behavior when it is subjected to the following pretreatment prior to deformation.

(i) Hot-worked duplex stainless steel is cold worked or warm worked at a temperature between 700° C. and room temperature and then is subjected to superplastic deformation at high temperatures;

(ii) Hot-worked duplex stainless steel is quenched or forced to cool and is cold worked or warm worked and then is subjected to superplastic deformation at high temperatures;

(iii) Hot-worked duplex stainless steel is further heat-treated and cooled to a temperature between 700° C. and room temperature, preferably between 500° C. and room temperature and then is subjected to superplastic deformation at high temperatures; and (iv) Hot-worked duplex stainless steel is quenched or forced to cool and then is subjected to superplastic deformation at high temperatures.

The above heat treatment is carried out in such a manner that the steel is soaked at a temperature of 1000° C. or higher, preferably at a temperature of between the alpha-temperature and a temperature 200° C. lower than the alpha-temperature and then quenched or forced to cool.

The alpha-temperature in the present specification defines the temperature at which a metallurgical structure transforms completely into a single phase of ferrite.

More specifically, the present invention is a superplastic deforming process of a duplex stainless steel, which comprises the steps of:

heating a ferrite+austenite duplex stainless steel to a temperature between the alpha-temperature and a temperature 200° C. lower than the alpha-temperature, the heating temperature being 1000° C. or higher;

water quenching or force-cooling the duplex stainless steel to a temperature of 500° C. or lower;

reheating it to a temperature of between 700° C., preferably 850° C., and a temperature 200° C. lower than the alpha-temperature; and plastic deforming the thus pretreated duplex stainless steel at a strain rate of $1\times10^{-4}$–$5\times10$ $S^{-1}$, preferably $1\times10^{-1}$–$5\times10$ $S^{-1}$ or $1\times10^{-3}$–$1\times10^{-1}$ $S^{-1}$.

Optionally, after quenching, the duplex stainless steel may be cold worked at a temperature of 200° C. or lower with a working ratio of 10% or more.

Preferably, the duplex stainless steel is a Cr-Ni-Fe-based steel exhibiting a duplex phase at room temperature.

In another aspect, the present invention resides in a plastic deforming process of a duplex stainless steel, which comprises the steps of:

heating a ferrite+austenite duplex stainless steel to a temperature between the alpha-temperature and a temperature 200° C. lower than the alpha-temperature, the heating temperature being 1000° C. or higher;

working the duplex stainless steel at a temperature of 700° C. or higher with a working ratio of 30% or more, or at a temperture lower than 700° C. with a working ratio of 20% or more;

reheating it to a temperature of between 700° C., preferably 850° C. and a temperature 200° C. lower than the alpha-temperature; and plastic deforming the thus pretreated duplex stainless steel at a strain rate of $1\times10^{-4}$–$5\times10\ S^{-1}$, preferably $1\times10^{-1}$–$5\times10\ S^{-1}$ or $1\times10^{-3}$–$1\times10^{-1}\ S^{-1}$.

DETAILED DESCRIPTION OF THE PREFERRED EMBODIMENTS

According to the present invention, an Fe-Cr-Ni system alloy is preferably used as a duplex stainless steel in view of its material cost and mechanical and chemical properties.

The duplex stainless steel employed in the present invention may further comprise, in % by weight:

| | |
|---|---|
| Mo: 0–5.0%, | Cu: 0–1.0%, |
| Zr: 0–1.0%, | Nb: 0–5.0%, |
| V: 0–1.0%, | W: 0–1.0%, |
| C: up to 0.1%, | and N: up to 0.2%. |

In addition thereto, Si and Mn used as a deoxidizing agent may be present in the following amounts:

| | | |
|---|---|---|
| Si: up to 5.0%, | and | Mn: up to 3.0%. |

Other elements, such as small amounts of Re, La, Ce, and Ca may be added if necessary.

One of the preferred embodiments of the duplex stainless steel advantageously used in the present invention comprises the following steel composition:

| | |
|---|---|
| C: not more than 0.05%, | Si: not more than 2%, |
| Mn: not more than 2%, | P: not more than 0.04%, |
| S: not more than 0.03%, | Cu: 0.1–0.6%, |
| Ni: 5–9%, | Cr: 22–35%, |
| Mo: 0.5–5%, | N: not more than 0.3%, |
| W: 0.05–1.5%, | |

and balance iron and incidental impurities.

Heating followed by quenching is effective to produce a duplex stainless steel suitable for superplastic deformation, since when it is reheated at a temperature within the above-defined range prior to plastic deformation, grains of a matrix ferrite become fine and austenite grains are also finely dispersed therein. The thus-obtained finely dispersed ferrite+austenite duplex microstructure is advantageous for superplastic deformation.

The heating temperature is preferably adjusted to a temperature at which a small amount of an austenite phase remains to prevent the growth of ferritic grains. At a temperature higher than the alpha-temperature the anomalous growth of ferritic grains proceeds. On the other hand, at a temperature much lower than the alpha-temperature coarse austenitic grains coagulate like islands and superplastic deformable characteristics are impaired. The lower limit is a temperature 200° C. lower than the alpha-temperature.

The above-mentioned temperature 200° C. lower than the alpha-temperature is usually higher than 1000° C. When the temperature 200° C. lower than the alpha-temperature is lower that 1000° C. due to its steel composition, the heating is carried out at a temperature not lower than 1000° C. Heating at a temperature lower than 1000° C. has deleterious effects on plastic deformation. Thus, the lower limit of the heating temperature is therefore defined as 1000° C.

According to the heating defined above, it is possible to provide a duplex stainless steel with fine grains of austenite finely dispersed in fine grains of ferrite phase when it is reheated prior to superplastic deformation.

The cooling after heating is carried out by water cooling or force cooling such as mist cooling, preferably by water cooling, so as to prevent other austenite grains from precipitating and growing coarse during cooling.

Thus, the duplex stainless steel is cooled to a temperature of 500° C. or lower so that austenitic grains are prevented from growing coarse. Preferably, after cooling, cold working with a working ratio of 10% or more is performed at a temperature of 200° C. or lower so as to promote the precipitation of fine austenitic grains when it is reheated prior to superplastic deformation. When the cold working is carried out at a temperature higher than 200° C., recovery of ferrite phase occurs during or after cold working, resulting in a decrease in the density of dislocations which act as nuclei for precipitation upon reheating.

According to another embodiment of the present invention, after the heating to the above-defined temperature range the duplex stainless steel may be worked at a temperature of 700° C. or higher with a working ratio of 30% or more, or at a temperature of lower than 700° C. with a working ratio of 20% or more. Such working is carried out to obtain a fine duplex microstructure. After working, the duplex stainless steel may be subjected directly to plastic deformation without reheating.

The duplex stainless steel is reheated to a temperature of between 700° C., preferably 850° C., and a temperature 200° C. lower than the alpha-temperature prior to superplastic deformation. When the reheating temperature is lower than 700° C., or sometimes lower than 850° C., not only does it take a long time for fine austenite grains to precipitate, but also the precipitation of sigma phase is significantly inhibited. The formation of sigma phase is important to achieve superplastic deformation. When the steel is reheated to a temperature higher than a temperature 200° C. lower than the alpha-temperature, the austenitic phase coagulates to grow coarse.

Depending on the steel composition, sometimes the precipitation of sigma phase occurs during deformation. Such sigma phase is extremely fine, and the precipitation thereof prevents austenitic or ferritic grains from coarsening. Thus, the precipitation of sigma phase promotes refinement of the metallurgical structure and is desirable from the standpoint of its effects on plastic deformation.

Duplex stainless steel is kept at the above-mentioned temperature for a while prior to deformation. The holding time therefor is preferably about one minute when it is heated to a temperature of 1000° C. or higher, and is 10–30 minutes for a heating temperature of 850°–900° C.

Plastic deformation takes place at a strain rate of $1\times10^{-4}$–$5\times10\ S^{-1}$, preferably $1\times10^{-1}$–$5\times10\ S^{-1}$ or $1\times10^{-3}$–$1\times10^{-1}\ S^{-1}$. As high a strain rate as possible is advantageous from an economic viewpoint. However, at a rate higher than $5\times10\ S^{-1}$, remarkably high superplastic deformation cannot be expected. The lower the rate, the longer it takes to finish deformation. Thus, this is not desirable from an economical viewpoint since heating must be continued during deformation, and thus for a longer period of time Alternatively, it is preferred to employ a strain rate in the range of $1\times10^{-3}$-$1\times10^{-1}$ $S^{-1}$, since dynamic recrystallization easily occurs during deformation.

Since according to the present invention, the resistance to deformation is very small when superplastic deformation takes place and the strain rate necessary therefor is rather high, duplex stainless steel can be deformed quite easily to a very large extent.

Some examples of superplastic deformed articles which can be produced by the process in accordance with the present invention are valves, pipe joints, syringe needles, and bath tubs. In the prior art, it has been impossible to produce such products by hot working, without use of machining or casting.

The present invention will be described in more detail in conjunction with working examples thereof, which are presented for merely illustrative purposes and do not restrict the present invention in any way.

EXAMPLE 1

Duplex stainless steels having the steel compositions shown in Table 1 were prepared by conventional processes. After breakdown by forging, hot rolling was performed to produce plates 12 mm thick.

The heat treatments indicated in Table 2 were applied to the plates and then hot tensile deformation was performed under conditions indicated in Table 2 to determine elongations.

Test results are summarized in Table 2.

As is apparent from Table 2, according to the present invention process, a satisfactory level of elongation, i.e., 100% or more, in most cases 300% or more was obtained even though the strain rate was rather high. Superplastic deformation was observed in accordance with the present invention process.

In contrast, the asterisks in Table 2 show the cases in which process conditions fell outside the range defined by the present invention. The elongation for the Comparative Examples was as small as that of conventional duplex stainless steel.

EXAMPLES 2-4

Example 1 was repeated using different process conditions, each of which is indicated in Tables 3 through 5, respectively, using the duplex stainless steels shown in Table 1. In Examples 2 and 4 the plates were 30 mm thick.

Test results are also summarized in Tables 3 through 5.

As is apparent therefrom, according to the present invention, plastic deformation can be carried out even at a relatively high strain rate.

In Test Run 11 for each of Examples 2 and 4, as shown in Tables 3 and 5, a large amount of sigma phase was precipitated since the heating temperature during pretreatment was 900° C., and so many cracks were produced during rolling that further testing had to be stopped.

Although the invention has been described with the preferred embodiments, it is to be understood that variations and modifications may be employed as will be apparent to those skilled in the art. Such variations and modifications are to be considered within the scope of the claims appended hereto.

TABLE 1

| | Chemical Composition (% by weight) | | | | | | | | | | | Temp.* |
|---|---|---|---|---|---|---|---|---|---|---|---|---|
| Steel | C | Si | Mn | P | S | Ni | Cr | Mo | N | Others | Fe + Impurites | (°C.) |
| A | 0.02 | 0.34 | 0.82 | 0.015 | 0.004 | 7.02 | 25.12 | 2.9 | 0.12 | Cu: 0.45, W: 0.31 | Bal. | 1320 |
| B | 0.02 | 0.49 | 1.75 | 0.014 | 0.003 | 5.67 | 22.25 | 2.85 | 0.14 | Ti: 0.3 | " | 1270 |
| C | 0.02 | 1.20 | 0.94 | 0.017 | 0.005 | 5.10 | 18.51 | 2.7 | — | La: 0.002 | " | 1210 |
| D | 0.02 | 1.01 | 0.98 | 0.016 | 0.003 | 7.0 | 28.0 | 2.5 | — | Cu: 0.60, Nb: 0.3 | " | 1310 |
| E | 0.04 | 0.60 | 0.51 | 0.015 | 0.014 | 6.0 | 22.0 | 2.0 | — | Ti: 0.30, Ce: 0.002 | " | 1230 |
| F | 0.03 | 0.75 | 0.84 | 0.015 | 0.003 | 10.0 | 28.0 | 1.5 | 0.12 | Zr: 0.2, Cu: 0.45, W: 0.30 | " | 1330 |

(Note)
*The temperature at which a structure changes to a single ferritic phase.

TABLE 2

| | | Pretreatment | | | Hot Deforming | | Hot Tensile Properties | | |
|---|---|---|---|---|---|---|---|---|---|
| Test Run | Steel | Heating Temp. (°C.) | Cooling | Working | Temp. (°C.) | Strain Rate ($sec^{-1}$) | Ultimate Stress ($kgf/mm^2$) | Elongation (%) | Remarks |
| 1 | A | 1340 | Water | None | 980 | $2\times10^{-3}$ | 3.5 | 1000+ | This |
| 2 | | | Cooling | | | $2\times10^{-1}$ | 11.1 | 165 | Invention |
| 3 | | | | | 680* | $4\times10^{-3}$ | 16.5 | 120 | Comparative |
| 4 | | 1250 | | | 980 | | 5.2 | 485 | This Invention |
| 5 | | 1050* | | | | | 5.3 | 176 | Comparative |
| 6 | | 1340 | Mist Cooling | | | | 4.4 | 550 | This Invention |
| 7 | | | Air Cooling* | | | | 4.7 | 158 | Comparative |
| 8 | | | Water | 30% at | 900 | $7\times10^{-3}$ | 10.2 | 585 | This Invention |
| 9 | | | Cooling | room temp. | | $7.5\times10^{-5}$* | 0.85 | 256 | Comparative |
| 10 | | | | | 690* | $7\times10^{-3}$ | 14.6 | 175 | |
| 11 | | 1200 | | | 900 | | 11.2 | 360 | This Invention |
| 12 | | | Air Cooling* | | | | 12.3 | 132 | Comparative |
| 13 | | 1050* | Water | | | | 12.2 | 184 | |
| 14 | B | 1300 | Cooling | None | 950 | $3\times10^{-3}$ | 4.2 | 732 | This |
| 15 | C | | | 20% at room temp. | | | 3.8 | 1000+ | Invention |
| 16 | D | | | None | | | 4.0 | 545 | |
| 17 | E | 1200 | | 40% at room temp. | 1000 | $2\times10^{-3}$ | 3.4 | 652 | |

TABLE 2-continued

| Test Run | Steel | Pretreatment Heating Temp. (°C.) | Cooling | Working | Hot Deforming Temp. (°C.) | Strain Rate ($sec^{-1}$) | Hot Tensile Properties Ultimate Stress ($kgf/mm^2$) | Elongation (%) | Remarks |
|---|---|---|---|---|---|---|---|---|---|
| 18 | F | 1300 | | None | 900 | $1 \times 10^{-2}$ | 11.3 | 320 | |

(Note)
*Outside the range of the invention.

TABLE 3

| Test Run | Steel | Pretreatment Heating Temp. (°C.) | Rolling Conditions (Temperature and Reduction in thickness) | Hot Deformation Temp. (°C.) | Strain Rate ($sec^{-1}$) | Hot Tensile Properties Ultimate Stress ($kgf/mm^2$) | Elongation (%) | Remarks |
|---|---|---|---|---|---|---|---|---|
| 1 | A | 1300 | 30% at 700° C. or higher, 10% at 700–500° C. | 950 | $2 \times 10^{-3}$ | 4.8 | 350 | This Invention |
| 2 | | | 50% at 700° C. or higher | | | 4.7 | 367 | |
| 3 | | | 30% at 700–400° C. | | | 4.6 | 412 | |
| 4 | | 1100 | 60% at 700° C. or higher | 1000 | | 5.0 | 322 | |
| 5 | | 1300 | 30% at 700–400° C. | | $1 \times 10^{-2}$ | 5.1 | 345 | |
| 6 | B | 1250 | 70% at 700° C. or higher | 900 | $2 \times 10^{-3}$ | 6.5 | 380 | |
| 7 | C | | | | | 6.1 | 365 | |
| 8 | D | | | | | 6.7 | 420 | |
| 9 | E | | | | | 6.0 | 321 | |
| 10 | F | | | | | 6.6 | 312 | |
| 11 | A | 900* | 35% up to 750° C., Many Cracks | — | — | — | — | Comparative |
| 12 | | 1250 | 15% up to 750° C.* | 1000 | $2 \times 10^{-3}$ | 5.2 | 145 | |
| 13 | | | 10% at 600–500° C. | 900 | | 5.0 | 212 | This Invention |
| 14 | | 1300 | 30% at 700° C. or higher, | 680* | | 17.2 | 68 | comparative |
| 15 | | | 20% at 700–500° C. | 1000 | $2 \times 10^{-1}$ | 11.4 | 165 | This Invention |
| 16 | | | | 1200* | $2 \times 10^{-3}$ | 0.74 | 70 | Comparative |

(Note)
*Outside the range of this invention.

TABLE 4

| Test Run | Steel | Pretreatment Heating Temp. (°C.) | Cooling | Working | Hot Deforming Temp. (°C.) | Strain Rate ($sec^{-1}$) | Hot Tensile Properties Elongation (%) | Remarks |
|---|---|---|---|---|---|---|---|---|
| 1 | A | 1300 | Water Cooling | None | 980 | $5 \times 10^{-1}$ | 210 | This Invention |
| 2 | | | | | | $7 \times 10$* | 85 | Comparative |
| 3 | | | | | 800* | $2 \times 10^{-1}$ | 90 | |
| 4 | | 1250 | | | 980 | | 180 | This Invention |
| 5 | | 1050* | | | | | 75 | Comparative |
| 6 | | 1350* | | | | | 90 | |
| 7 | | 1300 | Mist Cooling | | | | 170 | This Invention |
| 8 | | | Air Cooling* | | | | 50 | Comparative |
| 9 | | | Water | 30% at | 900 | $3 \times 10$ | 130 | This |
| 10 | | | Cooling | room temp. | | $5 \times 10^{-3}$ | 1000+ | Invention |
| 11 | | | | | 810* | $5 \times 10^{-1}$ | 95 | Comparative |
| 12 | | 1200 | | | 1050 | | 240 | This Invention |
| 13 | | | Air Cooling* | | | | 65 | Comparative |
| 14 | | 1050* | Water | | | | 85 | |
| 15 | B | 1250 | Cooling | None | 950 | $2 \times 10^{-1}$ | 130 | This |
| 16 | C | 1200 | | 20% at room temp. | | | 165 | Invention |
| 17 | D | 1280 | | None | | | 140 | |
| 18 | E | 1200 | | 40% at room temp. | 1000 | | 220 | |
| 19 | F | 1300 | | None | 900 | | 175 | |

(Note)
*Outside the range of the present invention.

TABLE 5

| Test Run | Steel | Pretreatment Heating Temp. (°C.) | Rolling Conditions (Temperature and Reduction in thickness) | Hot Deformation Temp. (°C.) | Strain Rate ($sec^{-1}$) | Hot Tensile Properties Elongation (%) | Remarks |
|---|---|---|---|---|---|---|---|
| 1 | A | 1300 | 30% at 700° C. or higher, 10% at 700–500° C. | 950 | $2 \times 10^{-1}$ | 200 | This Invention |
| 2 | | | 50% at 700° C. or higher | | | 220 | |

TABLE 5-continued

| Test Run | Steel | Pretreatment: Heating Temp. (°C.) | Pretreatment: Rolling Conditions (Temperature and Reduction in thickness) | Hot Deformation: Temp. (°C.) | Hot Deformation: Strain Rate ($sec^{-1}$) | Hot Tensile Properties Elongation (%) | Remarks |
|---|---|---|---|---|---|---|---|
| 3 | | | 30% at 700–400° C. | | | 250 | |
| 4 | | 1170 | 60% at 700° C. or higher | 1000 | | 200 | |
| 5 | | 1360 | 30% at 700–400° C. | | 1 | 180 | |
| 6 | B | 1250 | 70% at 700° C. or higher | 900 | $5 \times 10^{-1}$ | 180 | |
| 7 | C | 1200 | | | | 150 | |
| 8 | D | 1250 | | | | 200 | |
| 9 | E | | | | | 160 | |
| 10 | F | | | | | 150 | |
| 11 | A | 900* | 35% up to 750° C., Many Cracks | — | — | — | Comparative |
| 12 | | 1250 | 15% up to 750° C.* | 1000 | $5 \times 10^{-1}$ | 85 | |
| 13 | | | 10% at 600–500° C.* | 900 | | 78 | |
| 14 | | 1300 | 30% at 700° C. or higher, | 800* | | 65 | |
| 15 | | | 20% at 700–500° C. | 1000 | $1 \times 10^{2}$* | 90 | |
| 16 | | | | 1200* | $2 \times 10^{-1}$ | 65 | |
| 17 | | | | 950 | $5 \times 10^{-3}$ | 1000 or higher | This Invention |

(Note)
*Outside the range of this invention.

What is claimed is:

1. A superplastic deforming process of a duplex stainless steel, which comprises the steps of:

heating a ferrite+austenite duplex stainless steel to a temperature between the alpha-temperature and a temperature 200° C. lower than the alpha-temperature, the heating temperature being 1000° C. or higher;

water quenching or force-cooling the duplex stainless steel to a temperature of 500° C. or lower;

reheating it to a temperature of between 700° C. and a temperature 200° C. lower than the alpha-temperature; and plastic deforming the thus-pretreated duplex stainless steel at a strain rate of $1\times10^{-3}$–$1\times10^{-1}$ $S^{-1}$.

2. A superplastic deforming process of a duplex stainless steel as defined in claim 1, in which the duplex stainless steel is reheated prior to plastic deforming at a temperature of between 850° C. and a temperature 200° C. lower than the alpha-temperature.

3. A superplastic deforming process of a duplex stainless steel as defined in claim 1, in which the duplex stainless steel is a Cr-Ni-Fe-based steel exhibiting a duplex phase at room temperature.

4. A superplastic deforming process of a duplex stainless steel as defined in claim 1, in which after quenching or force-cooling said duplex stainless steel is cold worked at a temperature of 200° C. or lower with a working ratio of 10% or more.

5. A superplastic deforming process of a duplex stainless steel as defined in claim 4, in which the duplex stainless steel is reheated prior to plastic deforming at a temperature of between 850° C. and a temperature 200° C. lower than the alpha-temperature.

6. A superplastic deforming process of a duplex stainless steel as defined in claim 4, in which the duplex stainless steel is a Cr-Ni-Fe-based steel exhibiting a dual phase at room temperature.

7. A plastic deforming process of a duplex stainless steel, which comprises the steps of:

heating a ferrite+austenite duplex stainless steel to a temperature between the alpha-temperature and a temperature 200° C. lower than the alpha-temperature, the heating temperature being 1000° C. or higher;

working the duplex stainless steel at a temperature of 700° C. or higher with a working ratio of 30% or more;

reheating it to a temperature of between 700° C. and a temperature 200° C. lower than the alpha-temperature; and plastic deforming the thus-pretreated duplex stainless steel at a strain rate of $1\times10^{-3}$–$1\times10^{-1}$ $S^{-1}$.

8. A superplastic deforming process of a duplex stainless steel as defined in claim 7, in which the duplex stainless steel is reheated prior to plastic deforming at a temperature of between 850° C. and a temperature 200° C. lower than the alpha-temperature.

9. A superplastic deforming process of a duplex stainless steel as defined in claim 7, in which the duplex stainless steel is a Cr-Ni-Fe-based steel exhibiting dual phase at room temperature.

10. A plastic deforming process of a duplex stainless steel, which comprises the steps of:

heating a ferrite+austenite duplex stainless steel to a temperature between the alpha-temperature and a temperature 200° C. lower than the alpha-temperature, the heating temperature being 1000° C. or higher;

working the duplex stainless steel at a temperature lower than 700° C. with a working ratio of 20% or more;

reheating it to a temperature of between 700° C. and a temperature 200° C. lower than the alpha-temperature; and plastic deforming the thus-pretreated duplex stainless steel at a strain rate of $1\times10^{-3}$–$1\times10^{-1}$ $S^{-1}$.

11. A superplastic deforming process of a duplex stainless steel as defined in claim 10, in which the duplex stainless steel is reheated prior to plastic deforming at a temperature of between 850° C. and a temperature 200° C. lower than the alpha-temperature.

12. A superplastic deforming process of a duplex stainless steel as defined in claim 10, in which the duplex stainless steel is a Cr-Ni-Fe-based steel exhibiting dual phase at room temperature.

* * * * *